United States Patent [19]

Chalmers

[11] 4,051,611

[45] Oct. 4, 1977

[54] BOOT BUCKLE

[75] Inventor: Edward L. Chalmers, Boulder, Colo.

[73] Assignee: The Garcia Corporation, Teaneck, N.J.

[21] Appl. No.: 762,195

[22] Filed: Jan. 24, 1977

[51] Int. Cl.[2] ..... A43B 11/00

[52] U.S. Cl. ..... 36/50; 24/68 SK

[58] Field of Search ..... 36/50, 114, 117, 121, 36/25; 24/68 SK, 71 SK, 71 T, 71 J, 71 R, 68 R, 271, 69 SK

[56] References Cited

U.S. PATENT DOCUMENTS

| | | | |
|---|---|---|---|
| 3,173,182 | 3/1965 | Teufel | 24/68 SK |
| 3,363,288 | 1/1968 | Lange et al. | 24/68 SK |
| 3,545,106 | 12/1970 | Martin | 36/50 |
| 3,975,838 | 8/1976 | Martin | 24/71 SK |

*Primary Examiner*—G. V. Larkin

*Attorney, Agent, or Firm*—Fitzpatrick, Cella, Harper & Scinto

[57] ABSTRACT

A buckle for securing a pair of opposed closure flaps of an athletic boot comprises a catch mounted to one of the flaps and a latch mounted adjacent to the catch on the opposite flap. A wireform is mounted to the latch by means of a shaft pivoted on the latch, the shaft being threaded into a wireform holder to permit for longitudinal micro-adjustment of the wireform. The pivotal connection between the post and latch is arranged to permit limited play for alignment of the wireform and catch and includes a biasing member which urges the wireform and shaft toward the flaps when the buckle is disengaged.

6 Claims, 7 Drawing Figures

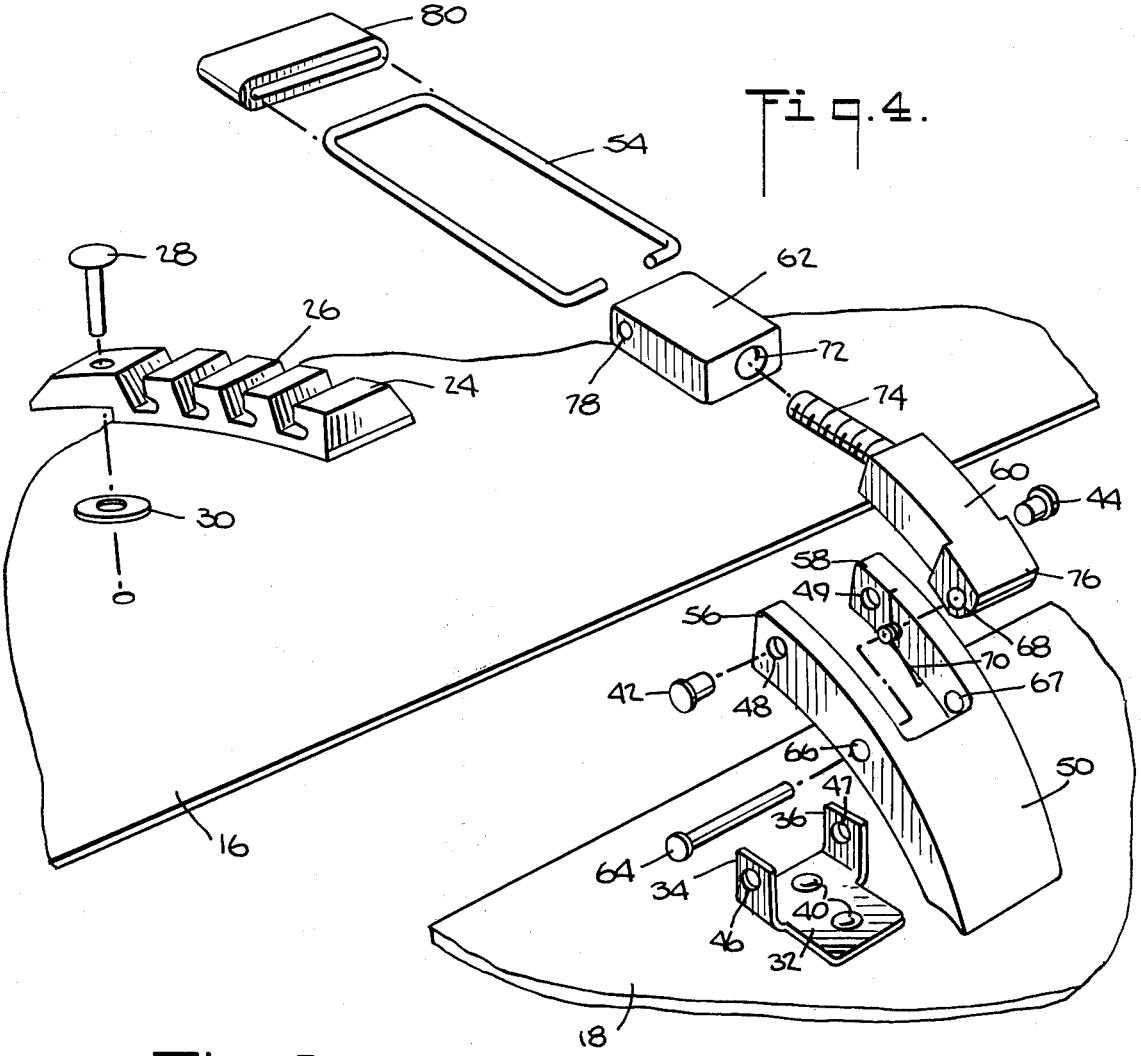
Fig. 4.
Fig. 5.
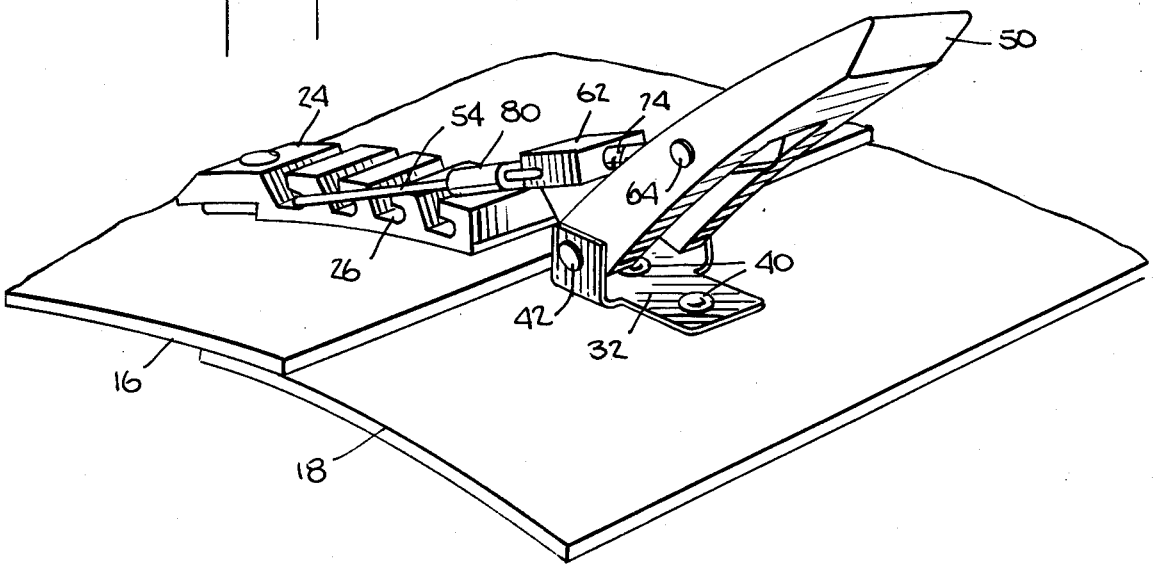

BOOT BUCKLE

BACKGROUND OF THE INVENTION

1. Field of the Invention

The present invention relates to fasteners for athletic boots and more particularly it concerns a novel buckle for closing a pair of opposed closure flaps of a ski boot about a skier's foot.

2. Description of the Prior Art

Particularly since the advent of molded ski boots, quick-release fasteners as buckles have become very popular and have replaced other fasteners, such as laces, for closing the boot. In one typical construction, as illustrated by U.S. Pat. No. 3,363,288, a loop or wireform is mounted to one of the boot flaps and a latch having a plurality of spaced-apart notches is pivotally connected to the opposed flap for engaging the wireform in one of the notches when the latch is in a first position and for securing the opposed boot flaps together when the latch is pivoted to a second position. However, with this type of construction, the mechanical advantage varies depending upon which notch the wireform engages, the least mechanical advantage being realized for the tightest setting. This is particularly troublesome to the skier when making tightness adjustments between ski runs when the hands are often cold and the buckle is often covered with ice or snow.

In another known buckle arrangement, as shown in U.S. Pat. No. 3,173,182, the wireform is mounted to the latch by means of a screw threaded into a nut which is pivotally supported in the latch.

In both of the aforementioned prior art designs, the tightness settings are macro-adjustable by changing the notch in which the wireform is engaged, as well as micro-adjustable by varying the longitudinal distance between the wireform and its support. While such arrangements are satisfactory, the construction thereof leads to the problem of possible damage to the buckle when it is unlatched. This is particularly a problem when the wireform is attached to the latch and is free to swing away from the boot in the unlatched condition. In such condition, the wireform is liable to damage; such as, by striking same against a door frame when walking, it being common practice by skiers to unbuckle boots when indoors.

Torsion springs or the like have been used in ski boot buckles such as is illustrated in French Pat. No. 1,542,459, to urge the wireform away from the boot surface to facilitate latching thereof. This only adds to the problem of damage when the buckle is unlatched.

In another aspect, it is also advantageous to reduce the number of buckles in a front entry ski boot from the customary five to four or even three. However, when this is done, wider buckles are required which necessitates greater accuracy in the alignment between the catch and wireform. Prior art fasteners have not been constructed with accurate alignment in mind and therefore, when used in sets of four or three, unnecessary stress has been placed on conventional boot fasteners and this, in turn, has reduced their useful life.

SUMMARY OF THE INVENTION

The present invention avoids the disadvantages of the prior art by means of a novel, quick-release buckle for an athletic boot, particularly the outer sheel of a molded ski boot, which is constructed so that the fastener portions on opposed boot surfaces may be readily aligned without exerting unnecessary stress to the fastener and in which the wireform is urged toward the boot surface to reduce the chance of accidental damage when the buckle is unlatched. The present invention further comprises an improvement over the prior art in that the buckle elements are constructed and arranged to provide a constant mechanical advantage for latching despite the tightness setting.

According to one aspect of the present invention there is provided a quick-release buckle for a ski boot or the like comprising a catch member having a plurality of longitudinally spaced, transverse notches, said catch being adapted to be secured to one of the closure flaps of said boot; a latch member pivotally connected to a support adapted to be secured to an opposite closure flap of said boot; and a wireform pivotally connected to the latch through adjustable mounting means, said mounting means and latch being dimensioned to permit the mounting means to pivot slightly about an axis perpendicular to the boot surface in relation to said latch; and biasing means arranged to urge said mounting means towards said boot surface.

There has thus been outlined, rather broadly, the more important features of the invention in order that the detailed description thereof that follows may be better understood and in order that the present contribution to the art may be better appreciated. There are, of course, additional features of the invention which will be described hereinafter and which will form the subject of the claims appended hereto. Those skilled in the art will appreciate that this invention may be utilized as a basis for designing other structures for carrying out the several purposes of this invention. It is therefore important that the claims be regarded as including such equivalent constructions as do not depart from the spirit and scope of the invention.

BRIEF DESCRIPTION OF THE DRAWINGS

Several embodiments of the invention have been chosen for purposes of illustration and description, as shown in the accompanying drawings forming a part of the specification, wherein:

FIG. 4 is an exploded perspective view of the embodiment illustrated in FIGS. 1-3;

FIG. 5 is a perspective view illustrating a wireform engaging the notches formed in a catch of a buckle according to the embodiment of FIGS. 1-4;

DETAILED DESCRIPTION OF THE PREFERRED EMBODIMENTS

Figure 1:
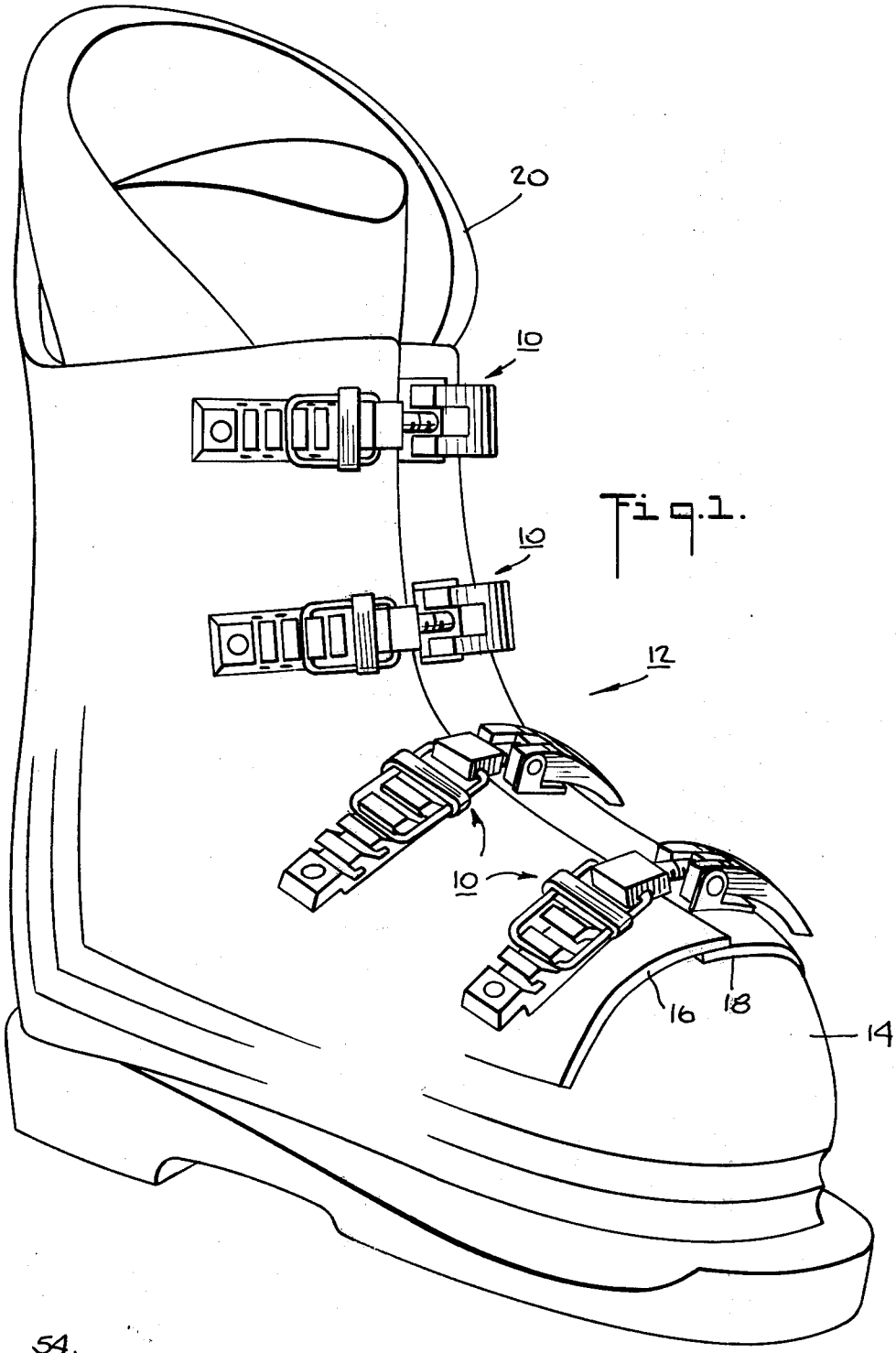
FIG. 1 is a perspective view of a molded athletic boot incorporating several buckles embodying the present invention.

Buckles 10 according to the present invention are particularly useful in association with a synthetic, molded ski boot such as shown in FIG. 1 and generally indicated by the reference numeral 12. The ski boot comprises an outer shell 14 formed with a pair of opposed closure flaps 16, 18 to which the fasteners 10 are mounted for locking or securing the flaps together about a padded inner boot 20. It should be understood that the boot configuration forms no part of the invention and is illustrative only. In addition, while the buckles of the present invention are especially adapted to be used in sets of four, as shown in FIG. 1, any number which provides the desired proper closure of the outer shell may be utilized.

Since each of the illustrated buckles 10 is identical, only one will be described in detail for purposes of simplicity and brevity.

As shown in FIGS. 2–5, and particularly FIG. 4, a catch 24 having a plurality of longitudinally spaced notches 26 is pivotally connected to closure flap 16 by a rivet pin 28 and spacer 30. When secured to the closure flap, catch 24 may pivot about rivet pin 28 for alignment of the various elements of the buckle as will be described hereinafter. As illustrated, notches 26 are preferably L-shaped to provide a firm seat for the wireform 54.

On the opposite closure flap 18, there is secured a support 32 having a pair of upstanding flanges 34, 36. The support 32 is firmly secured to the closure flap 18 by clinched rivets 40 extending therethrough.

An elongated lever or latch 50 having formed at one end thereof a pair of parallel, spaced arms 56, 58 is pivotally mounted to the upstanding flanges 46, 47 of support 32 by pins 42, 44 extending through accommodating bores 46, 47, 48 and 49 formed in the flanges 46, 47 and in the outermost extremities of arms 56, 58 of the latch 50. Thus, latch 50 pivots freely about an axis extending through pins 42, 44 generally parallel to the free edge of flap 18.

Figure 2:
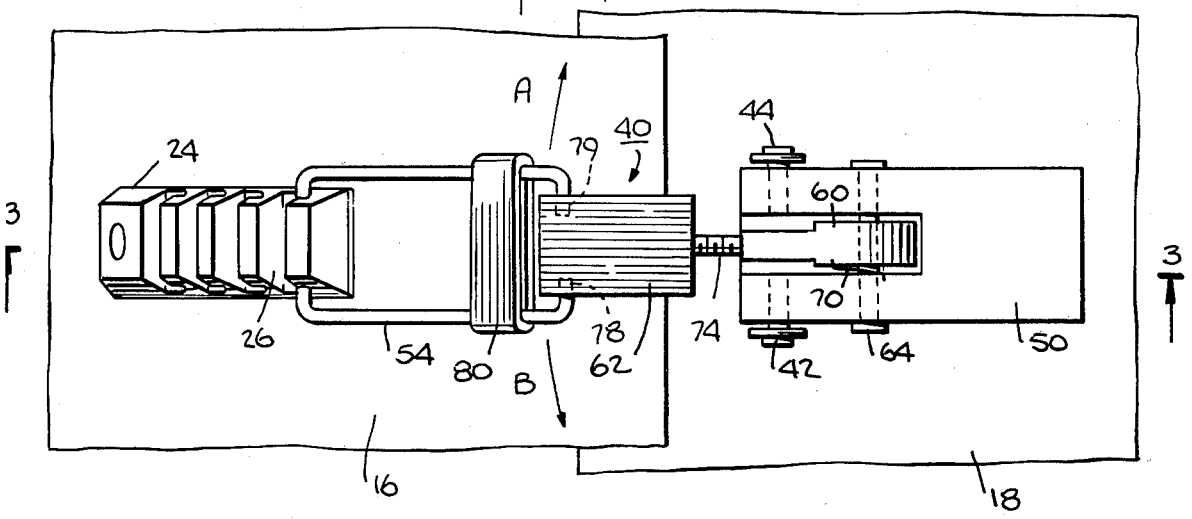
FIG. 2 is a plan view of one embodiment of the present invention.

To mount the wireform 54 to latch 50, a T-shaped member 60 is positioned between arms 56, 58. Member 60 is pivotally connected to latch between arms 56 and 58 by means of a pin 64 extending through bores 66, 67 and 68 in arms 56 and 58 and the head of the "T" respectively, mounting member 60 and latch 50 for relative rotational movement adjacent the ends of arms 56 and 58 remote from the outer extremities thereof. The width of the head 76 of member 60 is less than the spacing between arms 56, 58 and bore 68 has a diameter slightly greater than that of pin 64. Due to such configuration, member 60 can pivot in directions A and B as shown in FIG. 2.

Extending from the base of member 60 is a threaded shaft 74. A wireform holder 62 having a threaded bore 72 is screwed on to shaft 74. Finally, a generally U-shaped wireform having inwardly bents legs is pivotally mounted to the wireform holder 62 by inserting the inwardly bent portions into bores 78, 79 in the wireform holder. The inwardly bent portions are maintained therein by a sleeve 80 constructed of plastic or like material which slips over the wireform 54, as shown best in FIGS. 5 and 6, and dimensioned to retain the bent portions therein in their associated bores 78, 79.

Figure 3:
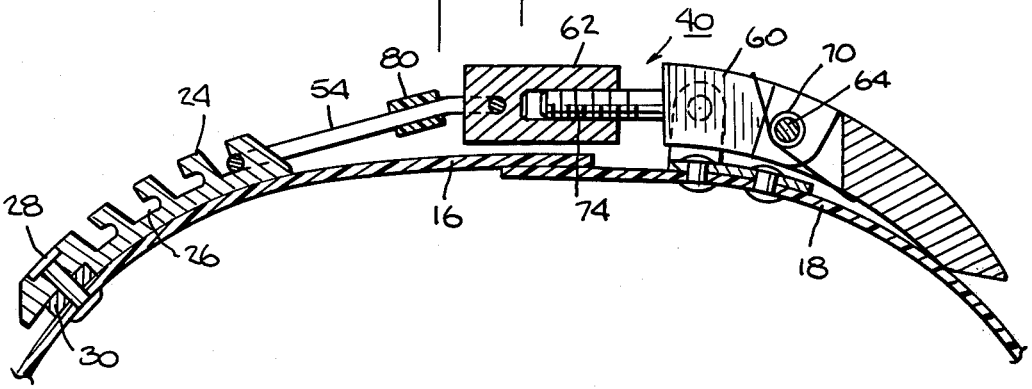
FIG. 3 is a section view taken along lines 3—3 of FIG. 2.

Spring 70, preferably a torsion-type spring, is positioned on pin 64 between arm 56 and member 60. As best shown in FIG. 3, one end of the spring engages the bottom surface of latch 50 while the other end engages element 60. Thus, the wireform assembly is normally biased toward the boot so that when the wireform 54 is disengaged from catch 24, it will lay flat against the surface of the boot. It will be readily appreciated that in the absence of spring 70, when the wireform 54 is disengaged, it and the shaft 74 are freely rotatable about pin 64 and can easily be bent or otherwise damaged if the boot is inadvertently hit against a wall or other surface. Preferably, the torsion spring 70 may be recessed in a slot (not shown) in the side of latch 50.

Figure 6:
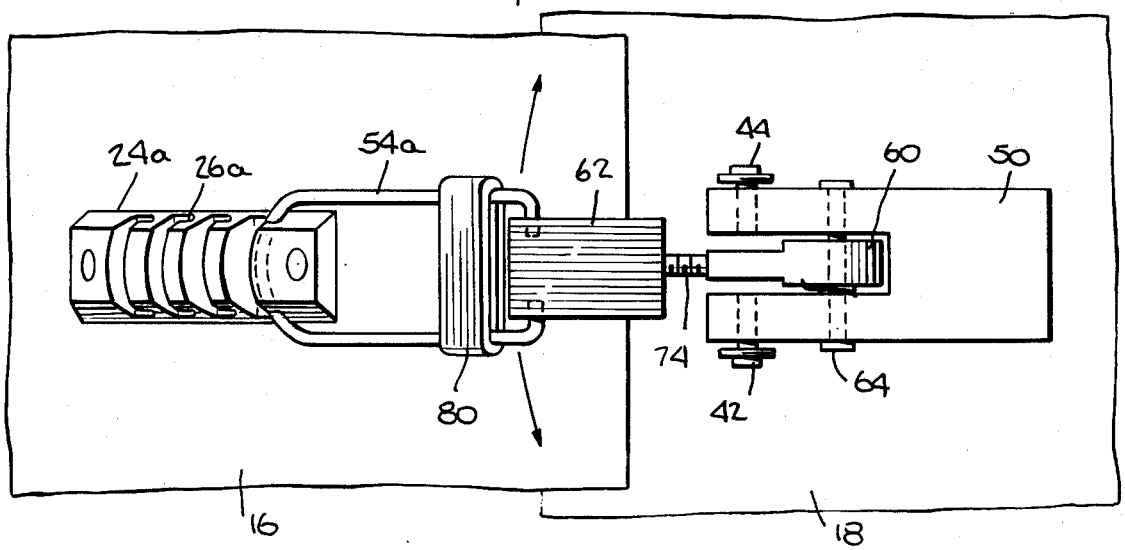
FIG. 6 is a plan view of another embodiment according to the present invention.

FIG. 6 shows an alternate embodiment of the present invention with similar elements being identified with similar reference numerals. In this embodiment, catch 24 is securely fastened in place to closure flap 16 by rivets located at opposite ends thereof. Since, in this embodiment, the catch cannot pivot for alignment with the wireform, the spaced-apart notches 26 are arcuate in contour. Similarly, the end of wireform 54 is also arcuately shaped instead of the previously described generally squared U-shape. In such manner, the wireform and catch self-align as the buckle is closed.

Figure 7:
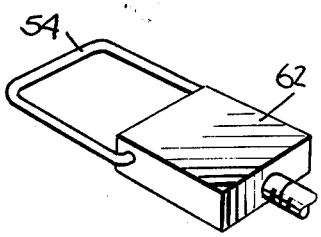
FIG. 7 is a perspective view of a wireform and its holder according to the present invention.

Due to the construction of the present invention, wireforms of different lengths may be readily interchanged, a wireform of shorter length being illustrated in FIG. 7. Thus, depending on the particular boot with which the fasteners are to be used, or the desired spacing between the catch and latch, any one of several wireform lengths may be provided, the selected wireform being retained in the wireform holder 62, by sleeve 80. To remove a wireform, it is necessary only to remove sleeve 80 by pulling it to the end of the wireform and then separating the ends of the wireform from the wireform holder 62. To attach a wireform, the reverse procedure is followed.

In operation, the flaps 16, 18 of the outer shell are initially pulled apart to permit entry of the wearer's foot into the inner boot 20. Once the foot is positioned within the boot, the flaps are manually drawn together and the catch 24 and latch unit 40 for the lowermost fastener are brought into alignment. This is facilitated by the slight pivotal movement of element 60 with respect to latch 50 in directions A or B, FIG. 2, together with the pivotal connection of the catch 24 in the FIG. 1 embodiment or the arcuate contour of notches 26 and wireform 54 in the embodiment of FIG. 6. Once the lowermost fastener is aligned, wireform 54 is brought into engagement with one of the notches 26 in a manner similar to that illustrated in FIG. 5. Latch 50 is then pivoted toward the surface of flap 18 to secure the opposed surfaces. The remaining three fasteners are subsequently engaged and locked in similar fashion.

If none of the notches 26 provides a comfortable tightness setting, micro or fine adjustment may be achieved by rotating the wireform holder 62 about the threaded shaft 74 one or two revolutions until a comfortable tightness setting is achieved.

The particular pivotal connection between the latch 50 and the wireform holder 62 provides an additional advantage over prior art fasteners. As shown for example in FIGS. 2 and 4, shaft 74 to which the wireform holder 62 is adjustably threaded, is spaced from pivot pin 64. As a result, stress is not concentrated on the threaded shaft 74 when the catch and latch unit are brought into alignment and the risk of bending the shaft is greatly reduced.

Finally, the buckle of the present invention may be constructed with the latch and catch being of considerable width which allows buckling load to be more spread on the boot shell eliminating pressure points.

What is claimed is:

1. A buckle for closing a pair of opposed closure flaps of an athletic boot comprising:

an elongated catch adapted to be mounted to one of said closure flaps, said catch having a plurality of longitudinally spaced transverse notches formed therein;

a support adapted to be mounted opposite to said catch on the other of said closure flaps;

an elongated latch having a pair of parallel legs pivotally mounted to said support for rotation towards and away from said catch;

a substantially U-shaped wireform dimensioned to engage one of said notches;

means mounting said wireform to said latch for rotation towards and away from said closure flaps, said mounting means including a member having a threaded shaft pivotally mounted between the arms of said latch, and a wireform holder threaded on said shaft, the free ends of said U-shaped wireform being mounted to said wireform holder for rotation towards and away from said flaps; and biasing means arranged between said member and said latch for urging said shaft and wireform holder towards said closure flaps.

2. A buckle according to claim 1 wherein said catch is constructed to be mounted to said one closure flap for rotation about an axis perpendicular to the surface of said flap.

3. A buckle according to claim 1 wherein said notches and the closed end of said wireform are arcuately contoured to facilitate alignment therebetween.

4. A buckle according to claim 1 wherein said biasing means is a torsion spring.

5. In a ski boot having a pair of closure flaps and a plurality of buckles arranged along said flaps for closing the flaps, at least one of said buckles comprising:

an elongated catch mounted to one of said closure flaps, said catch having a plurality of longitudinally spaced transverse notches formed therein;

a support mounted opposite to said catch on the other of said closure flaps, said support having a pair of upstanding flanges;

an elongated latch having a pair of parallel legs pivotally mounted to said flanges for rotation towards and away from said catch;

a substantially U-shaped wireform dimensioned to engage one of said notches;

means mounting said wireform to said latch for rotation towards and away from said closure flaps, said mounting means including a member having a threaded shaft pivotally mounted between the arms of said latch and a wireform holder threaded on said shaft, the free ends of said U-shaped wireform being mounted to said wireform holder for rotation towards and away from said flaps; and spring means arranged between said member and said latch for urging said shaft and wireform holder towards said closure flaps.

6. A buckle according to claim 5 wherein said spring means is a torsion spring.

* * * * *